US006676312B2

(12) United States Patent
Richard

(10) Patent No.: US 6,676,312 B2
(45) Date of Patent: Jan. 13, 2004

(54) RIBBON IDENTIFICATION USING OPTICAL COLOR CODED ROTATION SOLUTION

(75) Inventor: Yvan Richard, Nantes (FR)

(73) Assignee: Z.I.H. Corp., Wilmington, DE (US)

( * ) Notice: Subject to any disclaimer, the term of this patent is extended or adjusted under 35 U.S.C. 154(b) by 211 days.

(21) Appl. No.: 09/841,885

(22) Filed: Apr. 24, 2001

(65) Prior Publication Data

US 2002/0181990 A1 Dec. 5, 2002

(51) Int. Cl.[7] ..... B65H 75/00
(52) U.S. Cl. ..... 400/242; 400/208
(58) Field of Search ..... 400/249, 247, 400/244, 242, 219, 208, 207

(56) References Cited

U.S. PATENT DOCUMENTS

| | | | | |
|---|---|---|---|---|
| 3,591,281 A | | 7/1971 | Kruhlinski | 355/51 |
| 3,972,766 A | | 8/1976 | Fontvieille | 156/358 |
| 4,106,767 A | | 8/1978 | Schirrmeister et al. | 271/188 |
| 4,116,556 A | | 9/1978 | Tanaka et al. | 355/3 |
| 4,163,820 A | | 8/1979 | Corver et al. | 428/212 |
| 4,320,963 A | | 3/1982 | Satomi | 355/50 |
| 4,326,915 A | | 4/1982 | Mutschler, Jr. | 162/271 |
| 4,383,733 A | | 5/1983 | Weiss et al. | 350/130 |
| 4,415,623 A | | 11/1983 | Schlaepfer | 428/200 |
| 4,438,918 A | | 3/1984 | Ito et al. | 271/251 |
| 4,494,886 A | | 1/1985 | Kondo et al. | 400/208 |
| 4,502,804 A | | 3/1985 | Willcox | 400/641 |
| 4,586,834 A | | 5/1986 | Hachisuga et al. | 400/120 |
| 4,620,892 A | | 11/1986 | Dodson et al. | 156/319 |
| 4,623,902 A | | 11/1986 | Yamanishi | 346/76 |
| 4,654,099 A | | 3/1987 | Sandman | 156/220 |
| 4,684,119 A | | 8/1987 | Lane | 271/4 |
| 4,735,851 A | | 4/1988 | Dodson et al. | 428/326 |
| 4,797,016 A | | 1/1989 | Lahr | 400/237 |
| 4,819,932 A | | 4/1989 | Trotter, Jr. | 272/3 |
| 4,875,073 A | * | 10/1989 | Ueda et al. | 355/35 |
| 4,946,085 A | | 8/1990 | Nilsson et al. | 225/3 |
| 4,948,276 A | | 8/1990 | Haftmann et al. | 400/208 |
| 4,970,531 A | | 11/1990 | Shimizu et al. | 346/76 DH |
| 5,009,531 A | | 4/1991 | Koike | 400/240.3 |
| 5,031,896 A | | 7/1991 | Winkler | 271/258 |
| 5,087,137 A | | 2/1992 | Burnard et al. | 400/249 |
| 5,152,522 A | | 10/1992 | Yamashita | 271/264 |
| 5,290,114 A | | 3/1994 | Asami et al. | 400/208 |
| 5,326,182 A | * | 7/1994 | Hagstrom | 400/223 |
| 5,344,244 A | | 9/1994 | Fukahori et al. | 400/249 |
| 5,351,945 A | | 10/1994 | Asakawa et al. | 271/118 |
| 5,385,416 A | | 1/1995 | Maekawa et al. | 400/208 |
| 5,393,149 A | * | 2/1995 | Iima | 400/208 |
| 5,755,519 A | | 5/1998 | Klinefelter | 400/249 |
| 5,949,467 A | | 9/1999 | Gunther et al. | 347/214 |
| 5,957,594 A | | 9/1999 | Loidl | 400/237 |
| 5,996,775 A | | 12/1999 | Hendrickx | 198/780 |
| 6,056,843 A | | 5/2000 | Morita et al. | 156/250 |
| 6,059,280 A | | 5/2000 | Yamauchi et al. | 271/109 |
| 6,059,469 A | | 5/2000 | Hirumi | 400/208 |
| 6,396,526 B1 | * | 5/2002 | Sung et al. | 347/178 |

* cited by examiner

*Primary Examiner*—Anthony H. Nguyen
(74) *Attorney, Agent, or Firm*—Fulbright & Jaworski L.L.P.

(57) ABSTRACT

The present invention relates to a ribbon identifier that detects a color coded bank comprising multiple colored zones positioned on a ribbon core that fits in a printer. Each type of ribbon is associated with a specific and unique color coded band. The band may also be partly visible to the operator when loading the ribbon. When the color coded band is detected, the control program of the printer sets the parameters associated with that color coded band, ensuring proper printing.

14 Claims, 5 Drawing Sheets

RIBBON IDENTIFICATION USING OPTICAL COLOR CODED ROTATION SOLUTION

FIELD OF THE INVENTION

The present invention pertains to a color sensor solution used to identify the type of ribbon loaded in a printer by using a plurality of colored marks applied to the ribbon's core.

After the colored marks are detected, the printer automatically receives and sets the parameters to operate the printer using the particular type of ribbon detected.

The instant invention also protects the printer's components by refusing to operate when the detection system is unable to recognize the particular type of media that is loaded in the printer.

BRIEF DESCRIPTION OF RELATED ART

In the field of printer technology, numerous methods have been developed for applying ink to paper, cards or other print media in a controlled manner. One of the most common methods is using ink ribbons. A flexible ribbon substrate is impregnated or coated with ink that adheres to a paper or plastic card upon application.

Although "ink" is the term commonly used to describe this technology, the substance used for printing is typically not "ink" in the popular sense of the word. Porous ribbons, e.g., cloth, are usually impregnated with a dark powder which has enough liquid or gel content to promote its binding characteristics. Non-porous ribbons are typically coated on one side with a dry paste-like substance. In either case, the substance is usually referred to as "ink," and the ribbons as "ink ribbons." This terminology is common in the industry and is used in the following descriptions. The term"ribbon" as used herein is meant to encompass any type of printer technology that employs a flat, linear material wound around a spool.

At the time of printing, the back side of the ribbon is hit by one or more "hammers," which drive the front side of the ribbon against a paper or plastic card being printed on. The pressure and/or temperature of these hammers transfers some of the ink deposits from the ribbon to the paper's or card's surface in the shape of the hammer's impact surface. The surface of the hammer may be in the shape of a particular character, e.g., the letter "A," or a single dot which is combined with other dots to form a character. In either case, the method of transferring ink from a ribbon to the paper or the card is the same.

Since printer ribbons must be replaced periodically, most printers use spools designed to be replaced by an operator. Spools are also called "cores," and ribbon/spool combinations are usually sold as a single item.

Typically a spool is mounted on a spindle for operation, the spindle being generally cylindrical in shape and attached to a motor-operated assembly that controls the rotation of the spool. In most cases, only the take-up spool is controlled, while the supply spool is allowed to rotate freely as ribbon is removed from it by the force exerted on the ribbon by rotation of the take-up spool.

Removing the used spool from the spindle should be easy, fast and be done without tools by a non-technical person with little or no instruction.

In addition to standard ink ribbons and hammers, other printer technologies have also been developed. For example, thermal transfer, hot transfer, and die sublimation transfer.

Although these technologies differ from each other in significant ways, they have two things in common. First they typically involve a controlled transfer of the print substance from a substrate onto a print medium, and second, the act of printing depletes the print substance so that the substrate must periodically be replaced.

The use of replaceable ribbons, supply spools, and take-up spools is therefore common in many different types of printers.

Ribbon Identification Art

Several different types of ribbon can be used in a printer, such as monochromatic ribbons, colored ribbons, holograms, or overlays.

Each type of ribbon has several parameters that a printer needs to be adjusted to accommodate. For example, contrast/intensity, speed, offset, temperature, synchronization, and/or number of printing jobs available.

Having an operator manage the changing of parameters each time a new ribbon type is inserted into a printer creates a likelihood that the operator may make a mistake, thereby damaging the printer. Therefore, several kinds of ribbon identification devices have been developed.

Some prior art ribbons were detected through the use of magnets or by creating ribbon strips that have markings along the strip that can be detected. The problem with these prior art solutions are that the ribbon strips with markings require a complicated detection process for deciphering the code on the ribbon and much of the ribbon is wasted on the markings. Further, the magnets can be difficult to replace and are yet another tangible piece of the printer that need to be produced and later maintained.

Another prior art detection process is by attaching an identification device to the ribbon spool. The problem with this mode of detection is that any user could remove the attachment and put on a different one thus eliminating the benefit of having a detection process identify the type of ribbon used to set the parameters within the printer.

Optical Color Coded Art

A common ribbon identification device has a white LED (light emitting diode) and a photo-transistor positioned on the printer. The ribbon identification device can be considered according to three stages of development.

First, a pattern of marks, either mark being white or black, is applied on the customer side 62 of the core. See FIG. 1. The white mark reflects the highest light intensity produced by the white LED onto the photo-transistor, whereas the black mark reflects the lowest intensity as it absorbs the visible wavelengths. Considering the output voltage of the photo-transistor is directly proportional to the light intensity it receives, it is possible to set an identification system for two ribbons, one identification system having a white identifier and one having a black identifier. Depending upon the photo transistor, the output voltage is relative to the light intensity. A white mark may have an output voltage of 0 Volts, a black mark may have an output voltage of 5 Volts, therefore a 50% black gray mark may have an intensity of 2.5 Volts.

Second, an extension of the basic process described above consists of detecting various light intensities using a gray scale. A 100% black mark reflects the minimum light intensity and a 0% black mark is considered as a white mark and reflects the maximum light intensity. Therefore, a 50% black mark, or gray mark, reflects half of the intensity of a white mark.

The gray scale can then be extended according to the sensing element's receptiveness. For example, the sensing element may detect changes in increments of every 5% black or every 10% black.

This identification system is applicable for several different ribbons, one being a particular percentage of black "gray" per type of ribbon.

The number of identifiers needed depends on the scale of gray that the photo-transistor can identify.

The gray scale could be replaced by a color scale. The process is identical because each color has an equivalent light luminosity in the gray scale.

Third, it is possible to increase the number of identifiers by combining several gray scales in a band placed onto one ribbon. Each zone needs to have a different gray scale than the one before and the one after it. For example, if there are three zones, Zone 1, Zone 2 and Zone 3, any of the three zones can be filled with three different gray scales such as: gray 20%, gray 40%, gray 60%. Then, Zone 1 has 3 distinct grays available, Zone 2 has 2 distinct grays available, and Zone 3 has 2 distinct grays available.

In this example, if you multiply the possible number of colors available to fill each zone (3×2×2=12) you get 12 combinations used as identifiers.

In another configuration, if we consider a band made of five zones, each one of them is filled with any of four different colors, then there are (4×3×3×3×3=324) 324 identifiers available.

The problems with this technology are due to the detection criteria of light intensity and the loss of ribbon, the ribbon core must complete a full rotation before the ribbon identifiers have been detected. The ribbon loss in the prior art is further due to the fact that the identifier is not repeated over the entire circumference of the core. Thus, the ribbon core must be rotates one entire revolution in order for the sensor to read the entire identifier from the starting point to the end point.

The present invention overcomes the problems inherent in the prior art. The only identification criteria of light intensity in the prior art can be disrupt by any parasitic light source from inside or outside the mechanism at any time of the process.

SUMMARY OF THE INVENTION

The preceding and other shortcomings of the prior art are addressed and overcome by various aspects of the present invention.

To resolve the problems inherent in the prior art, a color sensor solution that is capable of detecting multiple colors for an unlimited number of combinations with quickness, precision and no ambiguity, that does not suffer from parasitic luminous sources and from loss of ribbon during the detection process is needed.

The present invention relates to a ribbon identifier that detects a color coded band comprising multiple colored zones positioned on a ribbon core that fits in a printer. Each type of ribbon is associated with a specific and unique color coded band. The band may also be partly visible to the operator when loading the ribbon. When the color coded band is detected, the control program of the printer sets the parameters associated with that color coded band, ensuring proper printing.

The foregoing and additional features and advantages of the present invention will become apparent by way of non-limitative examples shown in accompanying drawings and the detailed description that follows. In the figures and written description, numerals indicate the various features of the invention, like numerals referring to like features throughout both the drawings and the written description.

BRIEF DESCRIPTION OF THE DRAWINGS

The invention is shown by way of example in the accompanying drawings in which.

DETAILED DESCRIPTION OF THE PREFERRED EMBODIMENT

The present invention relates to a ribbon identifier using a color coded band 32 having multiple color coded zones 42 positioned on a ribbon core 34 to fit in a printer. Each type of ribbon is associated with a specific and unique color coded band. The color coded band 32 may also be partly visible to the operator when loading the ribbon.

Figure 1:
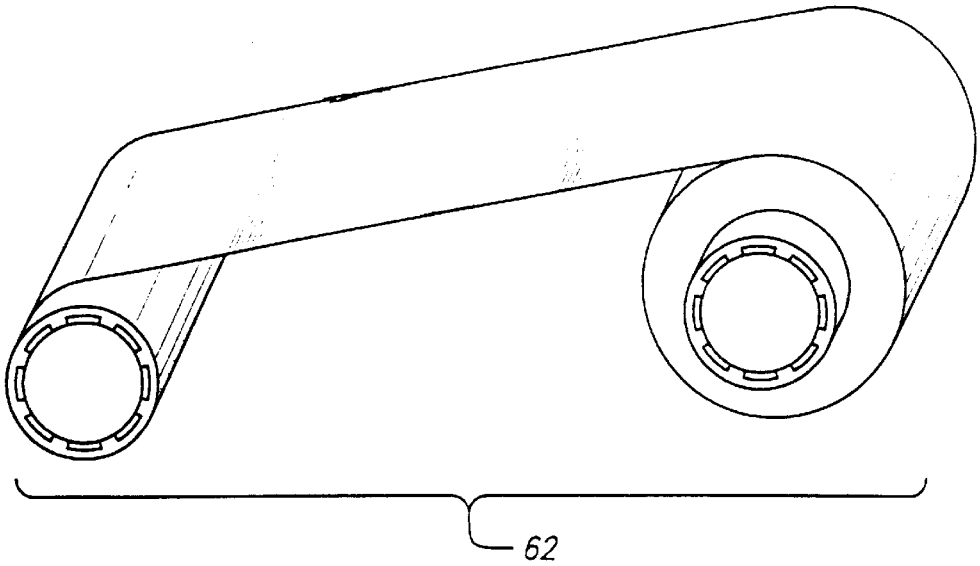
FIG. 1 is a perspective view of a prior art ribbon.
Figure 2:
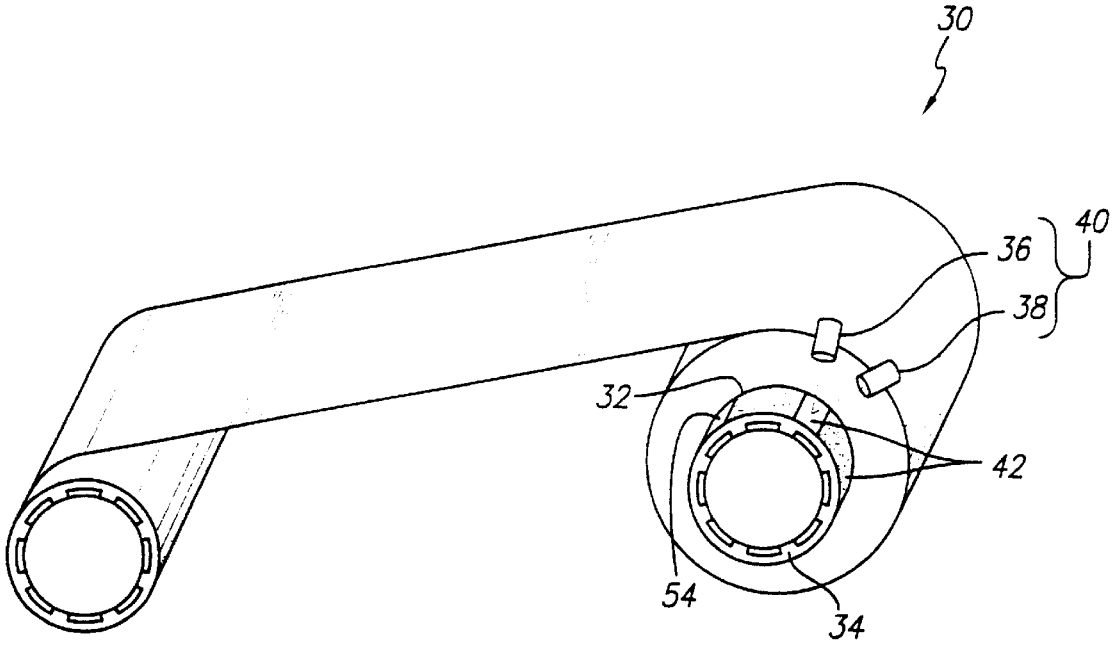
FIG. 2 is a perspective view of a first preferred embodiment according to the present invention.

Two types of ink ribbon structures are available: An ink ribbon rolled onto a core 30 (made of plastic ABS) fit onto a conventional printer spindle (See FIG. 2); and an ink ribbon cassette 60 that contains ink therein (See FIG. 4).

The color coded band 32 represents data, or parameters for a specified type of ribbon, that will be sent to the printer. Examples of data are: the type of ribbon loaded and the parameters associated with the particular type of ribbon, such as contrast, speed, offset, synchronization, ribbon capacity and ribbon life validity.

In order to read the color coded band 32 on the ribbon core 34, an optical color system 40 is positioned near the color coded band 32 on the core 34 and includes a white light emitter 36 for emitting a beam of light towards the color coded band 32, a color sensor 38 for sensing the beam of color which has been emitted from the white light emitter 36 and subsequently reflected back from each colored zone 42 of the color coded band 32, and a color code analyzer to analyze data from the color sensor. (See FIG. 2).

Figure 5:
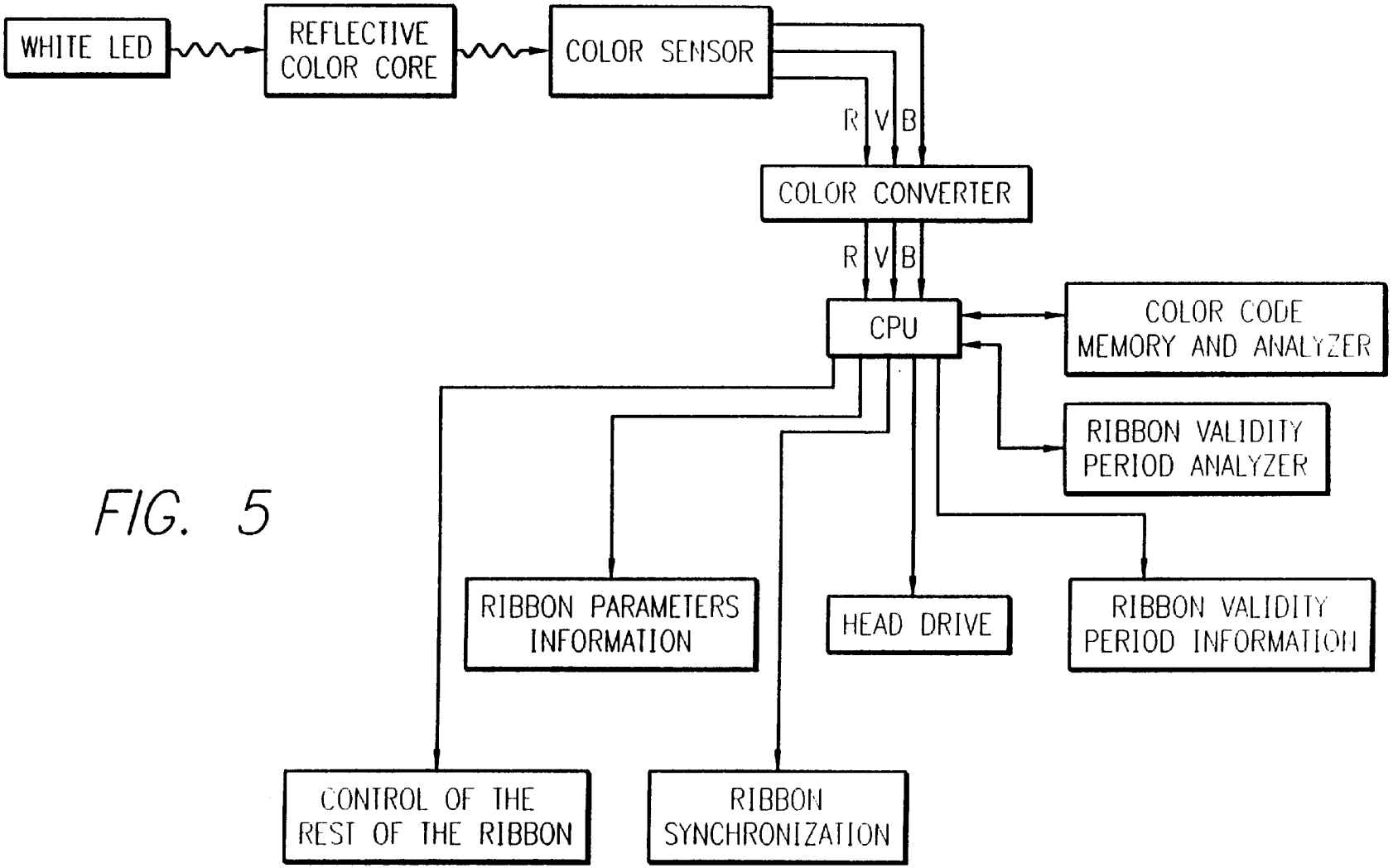
FIG. 5 is a block circuit diagram of the detection and implementation of the color code identifiers.

FIG. 5 shows the output signal from the color analyzer applied to a memory-controller where the type of ribbon loaded in the printer can be controlled, identified and supplied to the central processing unit "CPU." In response to the memory-controller, the CPU selects a printing mode and operates in accordance with a known thermal transfer process.

Once the ribbon has been loaded into the printer, the control program of the printer makes it operate a revolution so that the entire set of colored zones constituting the identifier can be detected by a color optical system fixed onto the printer. The present invention ensures proper ribbon loading prior to operation by being unable to set the printing parameters in the printer if the sensor is unable to read the ribbon core 34 or after the sensor reads the ribbon core the operating system of the printer is unable to identify the ribbon loaded in the printer. When the printer cannot read the ribbon core 34 it informs the operator that either the ribbon is loaded incorrectly or the operator has loaded ribbon that cannot be used within the printer.

After the sensor detects the colored zones 42, the optical color system 40 generates an exit signal which is compared to the memory data of the control program of the printer. The signal is rejected if the control program is unable to identify the ribbon type or the signal is validated by the printer. When the signal is validated the parameters associated with the color coded band 32, which is made up of a specific combination of colored zones 42, are sent to and used by the printing program.

Figure 3:
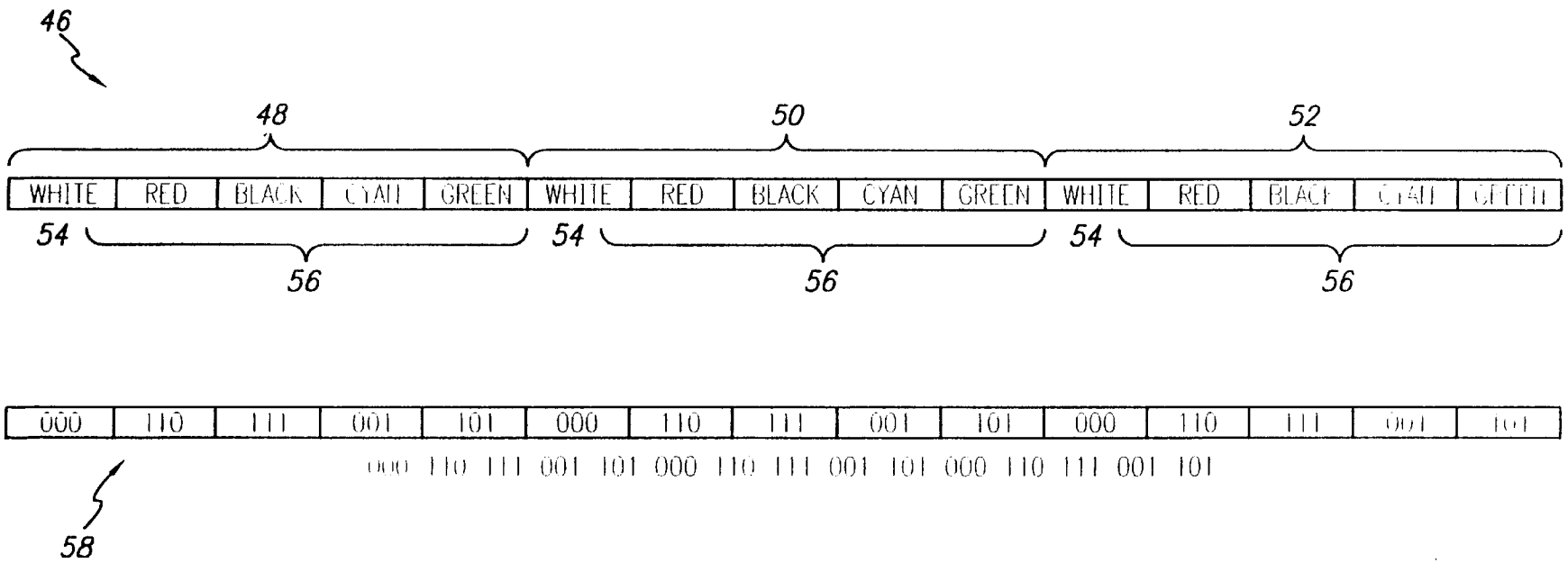
FIG. 3 is a table illustrating examples of color coded zones forming a color coded band.

The color coded band 46 as shown in FIG. 3 is laid flat showing how the color coded band 46 is divided into three identical parts 48, 50, 52 of five colored zones each. Each part 48, 50, 52 comprises four colored zones 56 and a start/stop color "white," 54 which indicates the beginning and the end of the reading cycle. Each colored zone 56 can take seven different colors: red, green, blue, yellow, magenta, cyan or black, therefore, 7×6×6×6=1512 different color bands. Thus, unlimited identifiers can be created by increasing the number of color coded zones and the number of times the color coded band is repeated.

For example, a color coded band is divided into four identical parts. Each part has six colored zones comprising five colored zones and a start/stop color "white." Each colored zone can be one of seven different colors: red, green, blue, yellow, magenta, cyan or black, the combination of these colors with the colored zones gives: 7×6×6×6×6=9072 color coded band configurations.

Figure 6:
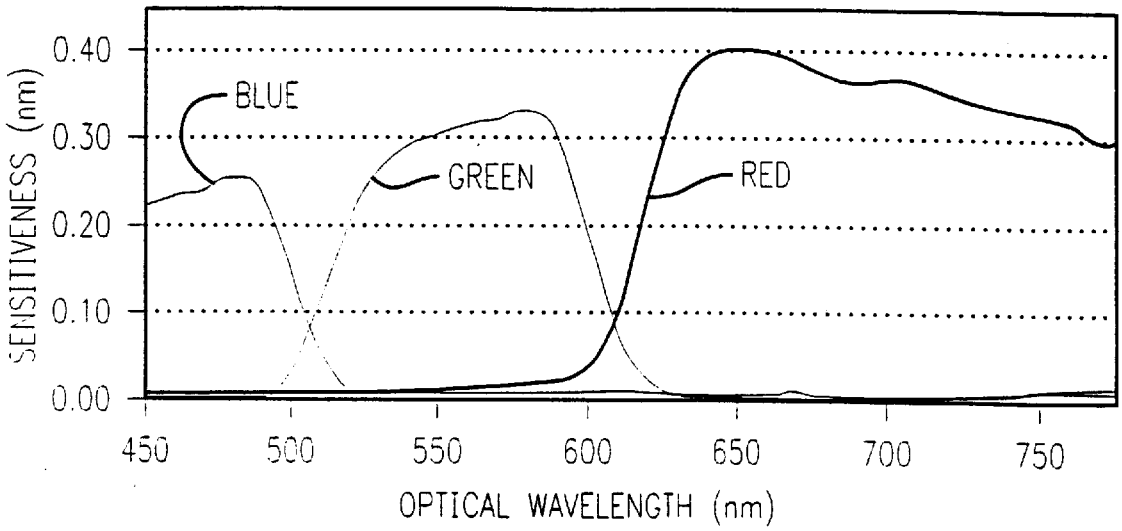
FIG. 6 is a graph of each primary color sensor wavelength (nm) versus the sensitiveness.

FIG. 3 further shows each color characterized by the optical color system by a set of three digital values (0 or 1). Each digital value represents the recognition of a specific color range which is the primary colors red, green and blue. These color ranges are detected simultaneously by one color sensor. The color sensor has Si-PIN (Silicone) diodes covered by RGB (red, green and blue) interference filters, a micro-lens array and an imaging micro-lens. Interference filters deposited on a glass substrate limit the sensor's spectral range to between 380 and 780 nm. (See FIG. 6).

The sensor used in the preferred embodiment is the MCS3 manufactured by MAZe T GmbH in Germany.

The interference filter of blue is yellow. The interference filter of green is magenta. The interference filter of red is cyan. Blue is a mix of magenta and cyan. Green is a mix of yellow and cyan. Red is a mix of yellow and magenta. Black is a mix of yellow, magenta and cyan. White is a mix of red, green and blue. Logical states 0 or 1, as seen on the chart below, are associated with each color. For example, the color white is associated with the digital value "000."

The present invention allows the optical color coded system to avoid problems with sensing due to light coming from luminous level detection or parasitic sources. The light coming from an artificial or natural white source will change the luminosity and saturation of the colors, but the sensor will be able to detect light red or dark red as red therefore, the tonalities remain the same. The following logical states are available:

| | White | Yel-low | Ma-genta | Cyan | Red | Green | Blue | Black |
|---|---|---|---|---|---|---|---|---|
| 1st Number | 0 | 1 | 0 | 0 | 1 | 1 | 0 | 1 |
| 2nd Number | 0 | 0 | 1 | 0 | 1 | 0 | 1 | 1 |
| 3rd Number | 0 | 0 | 0 | 1 | 0 | 1 | 1 | 1 |

A color scale with several levels from 0 to 100%, will give the same tonality information, and thus, the same logical state. For example a clear red or a deep red will give 1 1 0 as the logical state.

The color coded band 46 showing the equivalent digital representation 58 is the output signal of the optical color system 40.

The color coded band 46, the output signal from the optical color system 40, will create a logical suite of several 0s and/or 1s which will instruct the thermal printer as to which particular ribbon type has been loaded.

Figure 4A:
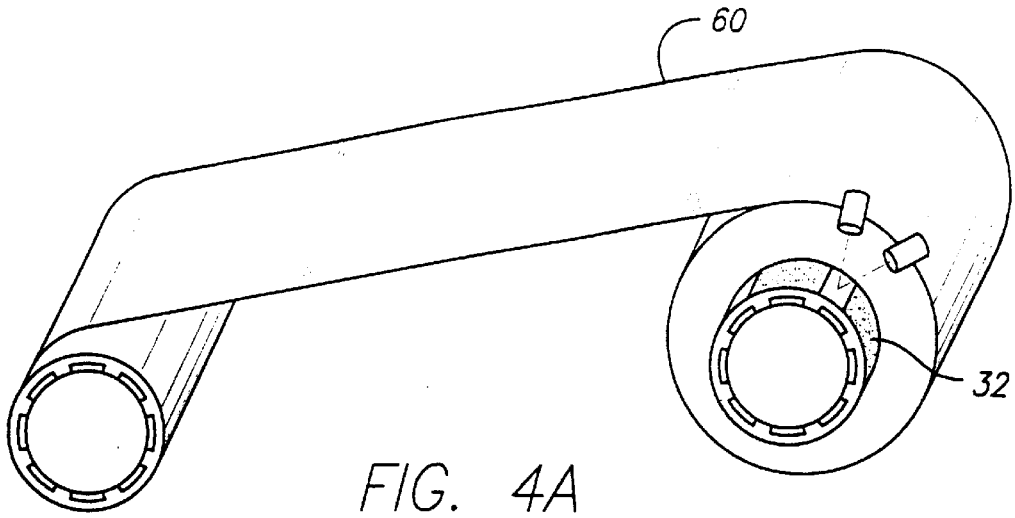
FIG. 4 is a perspective view of a second preferred embodiment according to the present invention.
Figure 4B:
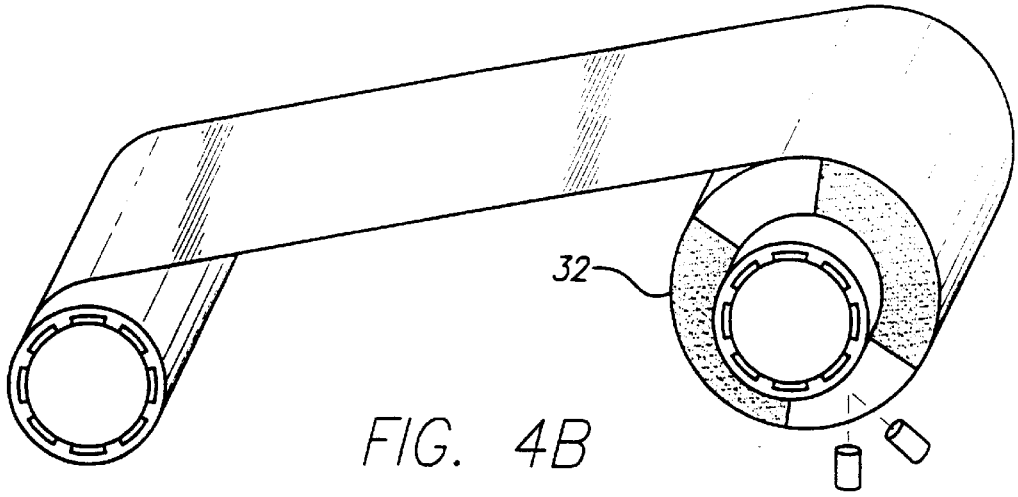
Figure 4C:
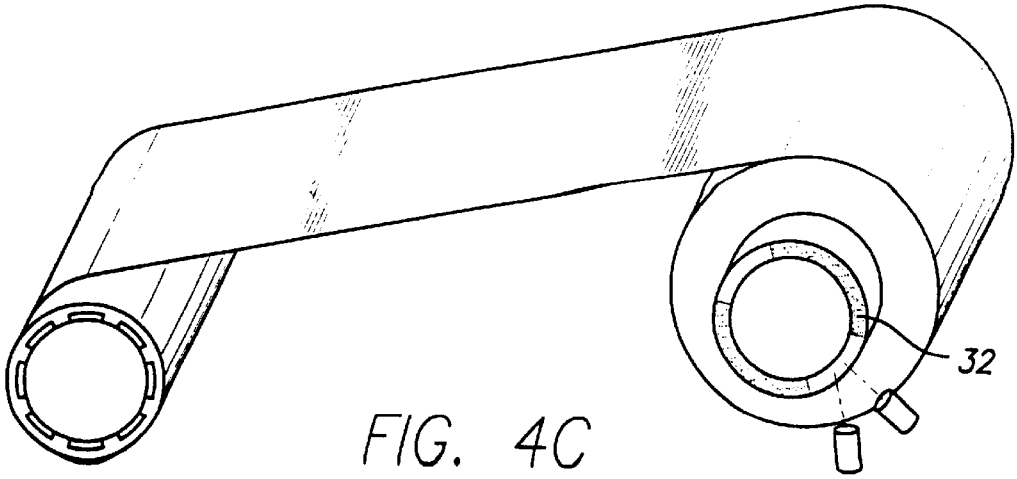

FIG. 4 illustrates three embodiments showing the color coded band 32 as used on a ribbon cassette 60. First, the color coded band 32 is positioned on the ribbon core (A), second, the color coded band 32 is positioned on the cassette itself (B), and third, the color coded band 32 is positioned on the face of the ribbon core (C).

Colored Zone Used to Detect a Ribbon's Validity Over Time

Instead of using white "start/stop" color coded zones to identify the beginning and/or end of the reading color code cycle, a changing color can be used according to the life time of the ribbon for a supplementary information regarding the ribbon validity period.

The color will change from white when it is at the beginning of its life time to black when the ribbon is outdated. This change of color will therefore have an effect on the color code, but will not impede the reading cycle of detection. The optical color system would use black as the "start/stop" colored zone. Thus, when the validity period of the ribbon has expired either the printer will give some indication that the ribbon installed is expired. In literature accompanying the printer or in a label placed directly on the printer, a statement informing the customers that the ribbon using outdated ribbon in the printer may damage the printing process, the printer and may affect the quality of the printing.

I claim:

1. A method for identifying the ribbon type in a media device, said method comprising the steps of:

(a) providing a ribbon core with at least one color coded ribbon identification band, said at least one color coded ribbon identification band including a sequence of zones of predetermined colors, each zone including only one said color and said sequence of zones collectively representing the type of ribbon being used in the media device, and said predetermined color being distinguishable from other predetermined colors by its respective wavelengths of reflected light independent of any variations in intensity, said ribbon core being adapted to revolve in the media device;

(b) illuminating said plurality of zones of said at least one color coded ribbon type identification band over at least one revolution of said ribbon core; and (c) sequentially sensing the wavelengths of light being reflected back from each of said illuminated zones for the purpose of identifying the ribbon type being used in the media device.

2. The method of claim 1, wherein step (b) includes providing at least one white light emitter for illuminating said plurality of zones.

3. The method of claim 1, wherein any two adjacent colored zones each comprise a different respective color selected from the group consisting essentially of red, green, blue, yellow, magenta, cyan, and black.

4. The method of claim 3, wherein each color is represented by a set of three digital values each corresponding to a different wavelength of light.

5. A ribbon type identifier system for use in a media device, said ribbon type identifier system comprising:

(a) a ribbon assembly including at least one color coded ribbon identification band, said at least one color coded ribbon identification band comprising a sequence of distinct colored-zones collectively representing the type of ribbon being used in the media device, said ribbon assembly being adapted to revolve in the media device, said ribbon assembly having a frontal edge, and a side edge;

(b) means for illuminating said plurality of color coded zones of said at least one color coded ribbon identification band over at least one revolution of said ribbon assembly; and (c) means for sensing a corresponding plurality of wavelengths being reflected back from each of said illuminated color coded zones for the purpose of identifying the ribbon type being used in the media device.

6. The ribbon type identifier system of claim 5, wherein any two adjacent colored zones comprise different respective colors, selected from the group consisting essentially of red, green, blue, yellow, magenta, cyan, and black.

7. The ribbon type identifier system of claim 4, wherein each color is represented by a set of three digital values each corresponding to a different wavelength of light.

8. The ribbon type identifier system of claim 3, wherein said at least one color coded ribbon identification band is provided on said frontal edge of said ribbon assembly.

9. The ribbon type identifier system of claim 3, wherein said at least one color coded ribbon identification band is provided on said side edge of said ribbon assembly.

10. The ribbon type identifier system of claim 3, wherein said ribbon assembly is operatively coupled to a ribbon cassette, said ribbon cassette having a first side disposed proximate to said side edge of said ribbon assembly.

11. The ribbon type identifier system of claim 10, wherein said at least one color coded ribbon identification band is provided on said first side of said ribbon cassette.

12. The ribbon type identifier system of claim 5, wherein at least one of said zones is adapted to change color for the purpose of detecting a ribbon's validity over time.

13. The ribbon type identifier system of claim 5, wherein said illuminating means includes at least one white light emitter for illuminating said plurality of zones.

14. The ribbon type identifier system of claim 3, further comprising at least one color code analyzer operatively coupled to said sensing means and adapted to analyze output data from said sensing means.

* * * * *